US007796912B2

(12) United States Patent
Sakagawa et al.

(10) Patent No.: US 7,796,912 B2
(45) Date of Patent: Sep. 14, 2010

(54) IMAGE FORMING METHOD AND APPARATUS WHICH USES ALTERNATING VOLTAGE TO FORM AN ELECTRIC FIELD FOR MOVING TONER

(75) Inventors: Yoshio Sakagawa, Ashiya (JP); Tetsumaru Fujita, Nishinomiya (JP); Yuji Nagatomo, Minoh (JP)

(73) Assignee: Ricoh Company Limited, Tokyo (JP)

( * ) Notice: Subject to any disclaimer, the term of this patent is extended or adjusted under 35 U.S.C. 154(b) by 216 days.

(21) Appl. No.: 12/023,544

(22) Filed: Jan. 31, 2008

(65) Prior Publication Data

US 2008/0187361 A1 Aug. 7, 2008

(30) Foreign Application Priority Data

Feb. 1, 2007 (JP) ..... 2007-023178

(51) Int. Cl.
*G03G 15/02* (2006.01)

(52) U.S. Cl. ..... 399/100; 399/50

(58) Field of Classification Search ..... 399/50, 399/100, 159, 174, 175, 176
See application file for complete search history.

(56) References Cited

U.S. PATENT DOCUMENTS 5,640,663 A * 6/1997 Hirai et al. ..... 399/159 X
5,715,499 A * 2/1998 Yamazaki et al. ..... 399/50
5,966,563 A * 10/1999 Kashihara et al. ..... 399/100
6,470,161 B2 * 10/2002 Fujishiro et al. ..... 399/159
6,898,393 B2 * 5/2005 Kawamura ..... 399/100
2007/0065179 A1 3/2007 Fujita
2007/0172259 A1 7/2007 Fujita
2007/0280735 A1 12/2007 Nagatomo et al.

FOREIGN PATENT DOCUMENTS

JP 2003-316202 11/2003
JP 2005-92090 4/2005

OTHER PUBLICATIONS

U.S. Appl. No. 12/187,021, filed Aug. 6, 2008, Shono et al.
U.S. Appl. No. 12/204,083, filed Sep. 4, 2008, Fujita et al.

* cited by examiner

*Primary Examiner*—Sandra L Brase
(74) *Attorney, Agent, or Firm*—Oblon, Spivak, McClelland, Maier & Neustadt, L.L.P.

(57) ABSTRACT

An image forming apparatus includes: an image carrying member having a movable surface; a charging device including a rotatable charging member which is supplied with a voltage including a direct voltage superimposed with an alternating voltage, and which contacts and charges the image carrying member; an electrostatic latent image forming device for forming an electrostatic latent image on the image carrying member; and a development device for developing the electrostatic latent image. The frequency of the alternating voltage is lower in a non-image forming area than in an image forming area. In the non-image forming area, the image carrying member is charged to a surface potential having a waveform shape in accordance with the alternating voltage, and the potential difference between the surface potential and the voltage applied to the charging member generates an electric field which moves toner adhering to the charging member to the image carrying member.

20 Claims, 5 Drawing Sheets

SURFACE POTENTIAL HAVING WAVEFORM SHAPE

IMAGE FORMING METHOD AND APPARATUS WHICH USES ALTERNATING VOLTAGE TO FORM AN ELECTRIC FIELD FOR MOVING TONER

CROSS-REFERENCE TO RELATED APPLICATION

This application claims priority to Japanese Patent Application No. 2007-023178 filed on Feb. 1, 2007, the entire contents of which are hereby incorporated by reference herein.

BACKGROUND OF THE INVENTION

1. Field of the Invention

The present invention relates to an image forming method and apparatus, such as a copier, a facsimile machine, and a printer, and more particularly, to a charging device for charging an image carrying member employed in the image forming method and apparatus.

2. Discussion of the Background Art

As a charging device for charging an image carrying member, a contact-type charging device is known which brings a charging member thereof, such as a charging roller and a charging brush roller, being supplied with a voltage (hereinafter referred to as the charge bias) by contact with the image carrying member.

In such contact-type charging device, if the charging member is supplied with the charge bias only including a direct voltage, uneven charging is more likely to occur than when the charging member is supplied with a voltage including a direct voltage with an alternating voltage superimposed. Consequently, there is a known charging device which uses, as the charge bias, the voltage including a direct voltage superimposed with an alternating voltage.

Even with the voltage including a direct voltage superimposed with an alternating voltage, however, if the alternating voltage has a relatively low frequency, uneven charging may occur in accordance with a number of valleys of the alternating voltage. In the contact-type charging device, therefore, the charging member is supplied with a direct voltage superimposed with an alternating voltage of a relatively high frequency, which is generally approximately 300 Hz (Hertz) to approximately 1000 Hz, so as to attain uniform charging.

Further, a photoconductor used as the image carrying member tends to be partially damaged by electrostatic discharge over time due to electrostatic stress on the photoconductor, if a ratio between a thickness of a surface layer of the image carrying member and absolute value of the surface potential of the photoconductor exceeds 30 V/μm (volts per micrometer). To increase the life of the photoconductor, therefore, preferably the photoconductor is used with the surface potential thereof set to a not excessively large value.

Further, a so-called cleaner-less image forming apparatus is known which does not include such devices as a cleaning blade for cleaning post-transfer residual toner remaining on the image carrying member after a transfer operation, and which collects the post-transfer residual toner into a development device. In the cleaner-less image forming apparatus, due to the potential difference between the surface potential of a non-image area of the image carrying member and a bias voltage applied to the development device, the post-transfer residual toner remaining on the non-image area of the image carrying member after the transfer operation is returned to the development device in a development step of the next and subsequent processes, i.e., when the image carrying member is again charged, exposed, and developed.

According to the method, the post-transfer residual toner is returned to the development device and reused in the development of an electrostatic latent image in the next and subsequent processes. It is therefore possible to eliminate waste toner and to reduce maintenance labor. Further, the absence of a waste toner container is advantageous in that it reduces the size of the image forming apparatus. Furthermore, it is possible to reduce the load on the image carrying member caused by the cleaning blade, and thus to improve the durability of the image carrying member.

In the use of the contact-type charging device, however, the residual toner on the image carrying member tends to adhere to the charging member when passing through a charging nip portion formed between the image carrying member and the charging member. If the adhesion repeatedly occurs and more than an allowable amount of toner adheres to the charging member, defective charging is caused. In particular, in the above-described cleaner-less image forming apparatus, the image carrying member passing through the charging nip portion carries thereon a relatively large amount of the residual toner. Thus, the adhesion of the toner to the charging member is remarkable.

In view of the above, an attempt has been made to clean the charging member by changing the charge bias in a non-image forming area immediately after the completion of a print job or between sheets during successive feeding of sheets in a continuous printing operation, for example, to thereby form an electrical field for causing the post-transfer residual toner adhering to the charging member to move to the image carrying member, and thus to transfer the post-transfer residual toner again to the image carrying member.

In one example of the above-described method, the image forming apparatus employs a negatively charged image carrying member and toner of negative polarity. In an image forming area, a charge bias generated by superimposing an alternating voltage on a direct voltage of the negative polarity is applied to the charging member to charge the image carrying member uniformly, i.e., to a constant value. Meanwhile, in a non-image forming area, the direct voltage of the charge bias applied to the charging member is set to be larger toward the negative polarity than the surface potential of the image carrying member. Due to the difference between the charge bias and the surface potential of the image carrying member, an electrical field is formed which causes the toner of the negative polarity adhering to a surface of the charging member to move to the image carrying member. Therefore, the toner adhering to the charging member is moved to the image carrying member. In the charge bias applied in the non-image forming area, the direct voltage is larger toward the negative polarity than the surface potential of the image carrying member, and the alternating voltage may be set to zero volts.

The image carrying member before entering the charging nip portion carries thereon toner of the reverse polarity (i.e., the positive polarity in the present example) in which the polarity has been reversed by the transfer process and weakly charged toner as well as the toner of the negative polarity. Such types of toner also adhere to the charging member. On the charging member, such types of toner are gradually charged to the negative polarity due to the electrical discharge or injection from the charging member, which has been supplied with the charge bias of the negative polarity in the image forming area. The toner on the charging member charged to the negative polarity is moved to the image carrying member by the electrical field, which is formed by the alternating voltage applied to the charging member and which causes the toner adhering to the charging member to move to the image carrying member. However, the toner, once adhered to the charging member, is difficult to move. Further, in the image forming area, the magnitude of the electric field is approximately half the peak-to-peak value $V_{p-p}$ of the alternating voltage, and is not sufficiently large. As described above, therefore, a relatively large direct voltage of the negative polarity is applied to the charging member in the non-image forming area so as to increase the electric field and thus move the toner to the image carrying member.

Further, to return the post-transfer residual toner on the image carrying member to the development device in the cleaner-less image forming apparatus, it is necessary that the post-transfer residual toner carried on the image carrying member has a normal charge polarity when the image carrying member has passed through the charging nip portion and arrived at a position facing the development device, and that the toner has been charged to a degree enabling the development device to develop an electrostatic latent image on the photoconductor. However, the reversely charged toner and the weakly charged toner cannot be returned from the image carrying member to the development device, and thus cause a defective image.

To prevent such a defect, it is effective for the cleaner-less system to charge the reversely charged toner and the weakly charged toner to the normal charge polarity on the charging member, as described above, and then to cause the toner to move onto the image carrying member and reach the position facing the development device.

However, in the image forming apparatus as described above, which changes the direct voltage to form the electric field for causing the post-transfer residual toner adhering to the charging member to move to the image carrying member, the electric field is changed by the amount of change of the direct voltage. It is difficult to apply a substantially large direct voltage without adversely affecting the longevity of the image carrying member. Meanwhile, if the above-described electric field is formed with the direct voltage changed within a practical range, it is difficult to move the toner adhering to the charging member effectively to the image carrying member.

SUMMARY OF THE INVENTION

This patent specification describes an image forming apparatus including an image carrying member, a charging device, an electrostatic latent image forming device, and a development device. The image carrying member has a movable surface. The charging device includes a rotatable charging member. The charging member is supplied with a voltage including a direct voltage superimposed with an alternating voltage, is and brought into contact with the image carrying member to charge the surface of the image carrying member. The electrostatic latent image forming device forms an electrostatic latent image on the surface of the image carrying member. The development device develops the electrostatic latent image formed on the surface of the image carrying member. The frequency of the alternating voltage included in the voltage applied to the charging member is set to be lower in a non-image forming area than in an image forming area. In the non-image forming area, the image carrying member is charged to a surface potential having a waveform shape in accordance with the alternating voltage, and an electric field for moving toner adhering to a surface of the charging member to the image carrying member is formed from the potential difference between the surface potential and the voltage applied to the charging member. Accordingly, the toner is moved from the charging member to the image carrying member.

This patent specification further describes an image forming apparatus including image carrying means, charging means, electrostatic latent image forming means, and development means. The image carrying member carries an image on a movable surface thereof. The charging means includes rotatable charging means, and causes the rotatable charging means to be applied with a voltage including a direct voltage superimposed with an alternating voltage, and to come in contact with the image carrying means to charge the surface of the image carrying means. The electrostatic latent image forming means forms an electrostatic latent image on the surface of the image carrying means. The development means develops the electrostatic latent image formed on the surface of the image carrying means. The frequency of the alternating voltage included in the voltage applied to the rotatable charging means is set to be lower in a non-image forming area than in an image forming area. In the non-image forming area, the image carrying means is charged to a surface potential having a waveform shape in accordance with the alternating voltage, and an electric field for moving toner adhering to a surface of the rotatable charging means to the image carrying means is formed from the potential difference between the surface potential and the voltage applied to the rotatable charging means. Accordingly, the toner is moved from the rotatable charging means to the image carrying means.

This patent specification further describes an image forming method including: rotating a movable surface of an image carrying member; applying a rotatable charging member of a charging device with a voltage including a direct voltage superimposed with an alternating voltage; charging the surface of the image carrying member by bringing the charging member into contact with the surface of the image carrying member; forming an electrostatic latent image on the surface of the image carrying member; and developing the electrostatic latent image formed on the surface of the image carrying member. The applying step sets the frequency of the alternating voltage included in the voltage applied to the rotatable charging means to be lower in a non-image forming area than in an image forming area. In the non-image forming area, the charging step charges the surface of the image carrying member to a surface potential having a waveform shape in accordance with the alternating voltage so that an electric field for moving toner adhering to a surface of the charging member to the image carrying member is formed from the potential difference between the surface potential and the voltage applied to the charging member. Accordingly, the toner is moved from the charging member to the image carrying member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF THE INVENTION

Figure 1:
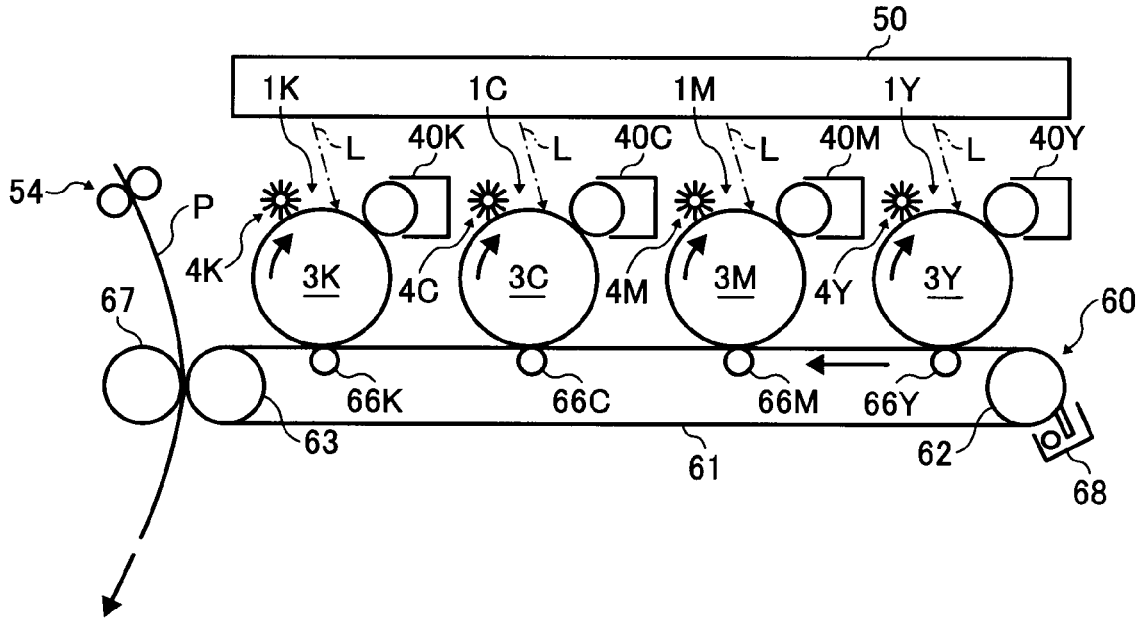
FIG. 1 is a schematic configuration diagram illustrating essential parts of a printer according to an embodiment of the present invention.

In describing the embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIG. 1, description will be made of an embodiment of a color laser printer (hereinafter referred to simply as the printer) according to an electrophotographic method, as an embodiment of an image forming apparatus according to the present invention. A basic configuration of the printer according to the present embodiment will be first described. FIG. 1 is a schematic configuration diagram illustrating essential parts of the printer according to the present embodiment.

The printer includes four processing units 1Y, 1M, 1C, and 1K for forming toner images in respective colors of yellow, magenta, cyan, and black (hereinafter referred to as Y, M, C, and K, respectively). The processing units 1Y, 1M, 1C, and 1K include, for example, corresponding drum-shaped photoconductors 3Y, 3M, 3C, and 3K serving as latent image carrying members, development devices 40Y, 40M, 40C, and 40K, and charging brush rollers 4Y, 4M, 4C, and 4K, respectively. The alphabetic characters Y, M, C, and K following respective referential numerals indicate that the members designated by the characters are members for forming the yellow, magenta, cyan, and black toner images. The printer further includes an optical writing unit 50, a registration roller pair 54, and a transfer unit 60.

The transfer unit 60 includes, for example, an intermediate transfer belt 61, a driven roller 62, a drive roller 63, four first transfer bias rollers 66Y, 66M, 66C, and 66K, and a second transfer bias roller 67. The intermediate transfer belt 61 is provided with a belt cleaning device 68.

The optical writing unit 50 includes, for example, a light source including four laser diodes corresponding to the respective colors of Y, M, C, and K, a polygon mirror formed into a regular hexahedron, a polygon motor for driving and rotating the polygon mirror, an fθ (theta) lens, and other lenses and reflecting mirrors (not illustrated). Laser beam L emitted from each of the laser diodes is reflected by one of the surfaces of the polygon mirror and deflected along with the rotation of the polygon mirror, and reaches one of the four photoconductors 3Y, 3M, 3C, and 3K, which will be described later. With the laser beam L thus emitted from each of the four laser diodes, a surface of each of the four photoconductors 3Y, 3M, 3C, and 3K is optically scanned.

Each of the photoconductors 3Y, 3M, 3C, and 3K is a tube made of such material as aluminum covered by an organic photosensitive layer. The photoconductors 3Y, 3M, 3C, and 3K are driven by a driving device (not illustrated) to rotate at a predetermined linear velocity in the clockwise direction in the drawing. Then, the photoconductors 3Y, 3M, 3C, and 3K are optically scanned in the dark by the optical writing unit 50, which emits the laser beam L modulated on the basis of image information transmitted from, for example, a personal computer (not illustrated). Thereby, the photoconductors 3Y, 3M, 3C, and 3K carry thereon electrostatic latent images for the colors of Y, M, C, and K.

Figure 2:
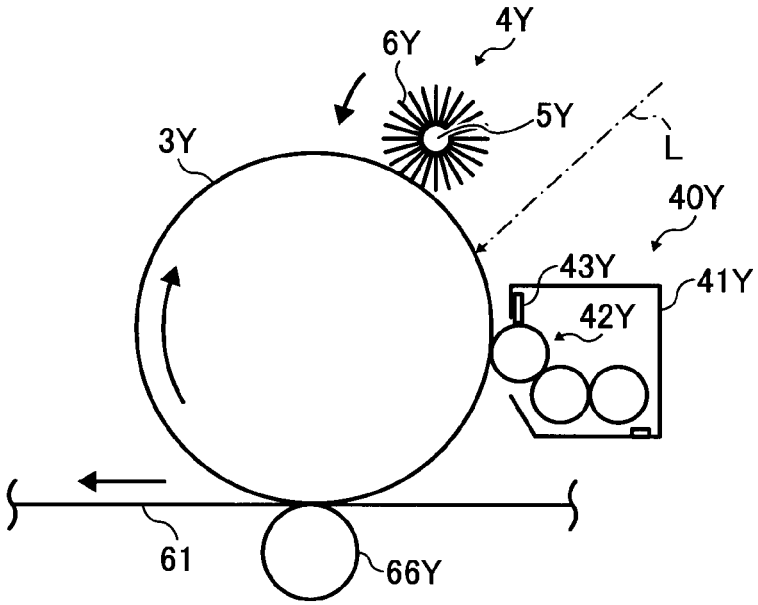
FIG. 2 is an enlarged configuration diagram illustrating a processing unit of the printer.

FIG. 2 is an enlarged configuration diagram illustrating the processing unit 1Y for the color Y of the four processing units 1Y, 1M, 1C, and 1K, and the intermediate transfer belt 61 of the transfer unit 60 illustrated in FIG. 1. In the drawing, the processing unit 1Y for the color Y holds, in a common unit casing (i.e., a retaining member), the photoconductor 3Y, the charging brush roller 4Y, a neutralizing lamp (not illustrated), the development device 40, and so forth to form one unit attachable and detachable with respect to the body of the printer. The development device 40 includes a casing 41Y, a development roller 42Y, a development doctor 43Y, and so forth. The charging brush roller 4Y includes a metal rotary shaft member 5Y and a plurality of conductive implanted fiber bristles 6Y.

The photoconductor 3Y for the color Y, which is a charged member and a latent image carrying member, is a drum having a diameter of approximately 24 mm (millimeters) including a conductive base member formed by an aluminum tube, for example, a surface of which is covered by a photosensitive layer made of a negatively charged organic photoconductor (OPC) material. The photoconductor 3Y is driven by a driving device (not illustrated) to rotate at a predetermined linear velocity in the clockwise direction in the drawing.

In the charging brush roller 4Y, the metal rotary shaft member 5Y is rotatably supported by a shaft bearing (not illustrated), and the plurality of conductive implanted fiber bristles 6Y are implanted upright on a surface of the rotary shaft member 5Y. The charging brush roller 4Y is driven by a driving device (not illustrated) to rotate about the rotary shaft member 5Y in the counter-clockwise direction in the drawing such that the distal end side of the respective implanted fiber bristles 6Y slides on and rubs against the photoconductor 3Y. The metal rotary shaft member 5Y is connected to a charge bias supply device (not illustrated) which includes a power supply, wiring, and so forth. Accordingly, the rotary shaft member 5Y is supplied with a charge bias generated by superimposing an alternating voltage on a direct voltage. In the present printer, the charging brush roller 4Y, the driving device (not illustrated) for driving to rotate the charging brush roller 4Y, the above-described charge bias supply device, and so forth constitute a charging device for uniformly charging the circumferential surface of the photoconductor 3Y. The charging device causes electric discharge between the photoconductor 3Y and each of the implanted fiber bristles 6Y of the charging brush roller 4Y to uniformly charge the surface of the photoconductor 3Y to the negative polarity, for example. The charging brush roller 4Y of the charging system is disposed in the processing unit 1Y to be attached to and detached from the body of the printer integrally with such members as the photoconductor 3Y.

The plurality of implanted fiber bristles 6Y of the charging brush roller 4Y are conductive fiber trimmed to a predetermined length. The material of the conductive fiber includes, for example, resin materials such as Nylon 6®, Nylon 12®, acrylic, vinylon, and polyester. Such a resin material is dispersed with conductive particles, such as fine carbon or metal particles, to be provided with conductivity. To reduce the production cost and the Young's modulus, it is preferable to employ conductive fiber formed of a nylon resin dispersed with the carbon particles. The carbon particles may be unevenly dispersed in the fiber. Meanwhile, the material of the rotary shaft member 5Y constituting the base member on which the plurality of implanted fiber bristles 6Y are implanted upright includes, for example, stainless steels such as SUS303, SUS304, SUS316, SUS416, SUS420, and SUS430. Alternatively, free-cutting steels such as SUM22, SUM23, SUM23L, and SUM24L with or without a plating treatment may be used. In consideration of the cost and safety (i.e., the non-use of lead), surface-plated SUM22 or SUM23 is preferable.

In place of the charging brush roller 4Y, a charging roller formed by a resilient member may be used as the charging member.

On the uniformly charged surface of the photoconductor 3Y for the color Y, an electrostatic latent image for the color Y is formed by the optical scanning performed by the foregoing optical writing unit 50. The electrostatic latent image is then developed into a Y-color toner image by the development device 40Y for the color Y.

In the development device 40Y for the color Y, the development roller 42Y has a circumferential surface partially exposed from an opening formed in the casing 41, and is driven to rotate by a driving device (not illustrated). The casing 41Y contains a Y-color developer (not illustrated) including negatively charged Y-color toner. As the Y-color developer is mixed and conveyed by mixing and conveying members, frictional charging of the Y-color toner is facilitated, and the Y-color developer is carried on a surface of the development roller 42Y. Then, along with the rotation of the development roller 42Y, the developer passes through a position facing the development doctor 43Y. In the passage through the position, the thickness of the layer of the developer is controlled, and the frictional charging of the developer is facilitated. Thereafter, the developer is conveyed to a development area facing the photoconductor 3Y.

In the development area, a development potential for electrostatically moving the Y-color toner of the negative polarity from the development roller 42Y to the electrostatic latent image formed on the photoconductor 3 acts between the latent image and the development roller 42Y applied with a development bias of the negative polarity output from a power supply (not illustrated). Further, a non-development potential for electrostatically moving the Y-color toner of the negative polarity from a uniformly charged portion (i.e., a background portion) of the photoconductor 3Y to the development roller 42Y acts between the background portion and the development roller 42Y. Due to the action of the development potential, the Y-color toner contained in the Y-color developer carried on the development roller 42Y is separated from the surface of the development roller 42Y and transferred onto the electrostatic latent image on the photoconductor 3Y. As a result of the transfer of the Y-color toner, the electrostatic latent image on the photoconductor 3Y is developed into the Y-color toner image. Through the development process, residual Y-color toner is returned into the casing 41Y along with the rotation of the development roller 42Y. The Y-color toner image on the photoconductor 3Y is then intermediately transferred onto the intermediate transfer belt 61 of the transfer unit 60 described later.

In the example described above, the one-component development device is employed. Alternatively, a so-called two-component development device, which uses a developer containing toner and magnetic carrier, may be used.

The Y-color toner image on the photoconductor 3Y is intermediately transferred onto the intermediate transfer belt 61 at a first transfer nip for the Y-color, at which the photoconductor 3Y comes in contact with the intermediate transfer belt 61. Having passed through the first transfer nip, the photoconductor 3Y carries post-transfer residual toner, which has not been transferred onto the intermediate transfer belt 61, adhering to the surface of the photoconductor 3Y.

The above description has been made of the processing unit 1Y for the Y-color. Each of the other processing units 1M, 1C, and 1K is similar in configuration to the processing unit 1Y for the Y-color. Thus, description of other processing units 1M, 1C, and 1K will be omitted.

In FIG. 1 described above, the transfer unit 60 is provided under the processing units 1Y, 1M, 1C, and 1K for the respective colors. The transfer unit 60 circularly moves the loop-like intermediate transfer belt 61 in the counter-clock direction in the drawing, while stretching the intermediate transfer belt 61 with tension with the use of a plurality of tension rollers. Specifically, the tension rollers include the driven roller 62, the drive roller 63, and the four first transfer bias rollers 66Y, 66M, 66C, and 66K, for example.

The driven roller 62, the drive roller 63, and the four first transfer bias rollers 66Y, 66M, 66C, and 66K are all in contact with the back surface of the intermediate transfer belt 61 (i.e., the inner circumferential surface of the loop). Each of the four first transfer bias rollers 66Y, 66M, 66C, and 66K is a roller formed by a metal core bar covered by a resilient member made of such material as sponge. The four first transfer bias rollers 66Y, 66M, 66C, and 66K are pressed against the photoconductors 3Y, 3M, 3C, and 3K for the respective colors of Y, M, C, and K, respectively, to sandwich therebetween the intermediate transfer belt 61. Thereby, four first transfer nips for the colors of Y, M, C, and K are formed at which the intermediate transfer belt 61 are in contact with the four photoconductors 3Y, 3M, 3C, and 3K, respectively, over a predetermined length in the moving direction of the intermediate transfer belt 61.

The core bar of each of the four first transfer bias rollers 66Y, 66M, 66C, and 66K is supplied with a first transfer bias, which is subjected to a constant current control by a corresponding transfer bias power supply (not illustrated). Accordingly, a transfer charge is applied to the back surface of the intermediate transfer belt 61 via the four first transfer bias rollers 66Y, 66M, 66C, and 66K, and a transfer electric field is formed in each of the first transfer nips between the intermediate transfer belt 61 and the photoconductors 3Y, 3M, 3C, and 3K. In the present printer, the first transfer bias rollers 66Y, 66M, 66C, and 66K are provided to constitute a first transfer device. In place of the first transfer bias rollers 66Y, 66M, 66C, and 66K, such devices as brushes and blades may be employed. Alternatively, a transfer charger, for example, may be employed.

The toner images of the colors Y, M, C, and K formed on the photoconductors 3Y, 3M, 3C, and 3K for the respective colors are transferred in superimposition onto the intermediate transfer belt 61 at the first transfer nips for the respective colors. Thereby, a four-color superimposed toner image (hereinafter referred to as the four-color toner image) is formed on the intermediate transfer belt 61.

A portion of the outer surface of the intermediate transfer belt 61 passing over the drive roller 63 is in contact with the second transfer bias roller 67. With this configuration, a second transfer nip is formed. The second transfer bias roller 67 is supplied with a second transfer bias by a voltage application device (not illustrated) including a power supply and wiring. Thereby, a second transfer electric field is formed between the second transfer bias roller 67 and the grounded drive roller 63, which is on a back side of the second transfer nip. As the intermediate transfer belt 61 circularly moves, the four-color toner image formed on the intermediate transfer belt 61 enters the second transfer nip.

The present printer includes a sheet feeding cassette (not illustrated) for storing therein a bundle of a plurality of stacked recording sheets P. From the sheet feeding cassette, a recording sheet P on the top of the bundle is sent to a sheet feeding path at a predetermined timing. The thus sent recording sheet P is nipped in a registration nip of the registration roller pair 54 provided at an end portion of the sheet feeding path.

Two rollers of the registration roller pair 54 are driven and rotated to nip, at the registration nip, the recording sheet P sent from the sheet feeding cassette. As soon as the registration roller pair 54 nips a leading end of the recording sheet P, the driving and rotation of the two rollers is stopped. Then, the registration roller pair 54 sends the recording sheet P to the second transfer nip at a timing in synchronization with the four-color toner image on the intermediate transfer belt 61. At the second transfer nip, a second batch transfer is performed in which the four-color toner image on the intermediate transfer belt 61 is transferred at one time onto the recording sheet P by the action of the second transfer electric field and a nip pressure. Thereby, the four-color toner image is blended with the white color of the recording sheet P to form a full-color image.

The recording sheet P thus formed thereon with the full-color image is discharged from the second transfer nip and sent to a fixing device (not illustrated) to have the full-color image fixed thereon.

Post-second transfer residual toner adhering to the surface of the intermediate transfer belt 61 after the passage of the intermediate transfer belt 61 through the second transfer nip is removed from the surface of the intermediate transfer belt 61 by the belt cleaning device 68.

The post-transfer residual toner also adheres to the surfaces of the photoconductors 3Y, 3M, 3C, and 3K after the passage of the photoconductors 3Y, 3M, 3C, and 3K through the respective first transfer nips. In the present printer, the processing units 1Y, 1M, 1C, and 1K for the respective colors are not provided with a cleaning device for cleaning the post-transfer residual toner. The present printer employs a cleanerless system which collects the post-transfer residual toner onto the development rollers of the respective development devices.

In the present printer having the above-described basic configuration, each of the four photoconductors 3Y, 3M, 3C, and 3K functions as a latent image carrying member for carrying a latent image on a surface thereof, which circularly moves along with the rotation thereof. Further, the optical writing unit 50 functions as a latent image forming device for forming latent images on the uniformly charged surfaces of the photoconductors 3Y, 3M, 3C, and 3K. Furthermore, a drive source and transmission system (not illustrated), which include a motor and a gear sequence for driving and rotating each of the photoconductors 3Y, 3M, 3C, and 3K to circularly move the surface of the photoconductor, and a drive control device (not illustrated), which performs an ON-OFF control of the drive source, function as a latent image carrying member driving device. The drive control device includes a control circuit including a known CPU (Central Processing Unit), and an information storage device such as a RAM (Random Access Memory).

Further detailed description will be made of the charging device, which characterizes the printer according to the present embodiment.

Figure 3:
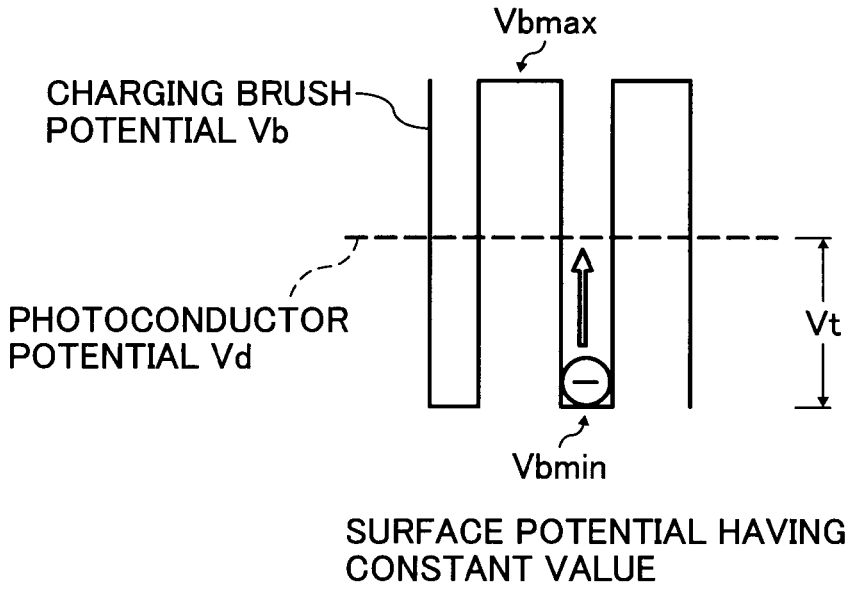
FIG. 3 is an explanatory diagram of a waveform of a charge bias and a surface potential of a photoconductor of the printer in an image forming area.

In the image forming area, the charging brush roller 4Y is supplied with a charge bias generated by superimposing an alternating voltage of a relatively high frequency on a direct voltage, so as to uniformly charge the photoconductor 3Y. For example, to uniformly charge the photoconductor 3Y rotating at a linear velocity of approximately 100 mm/sec (millimeters per second) to a voltage of approximately −500 V (volts), the charging brush roller 4Y is supplied with a charge bias Vb generated by superimposing an alternating voltage having a peak-to-peak value $V_{p\text{-}p}$ of approximately 1.0 kV (kilovolts), a duty ratio of approximately 45%, and a frequency of approximately 300 Hz on a direct voltage of approximately −500 V. The linear velocity of the charging brush roller 4Y is herein assumed to be approximately 250 mm/sec. FIG. 3 illustrates a waveform of the charge bias Vb applied to the charging brush roller 4Y and a surface potential Vd of the photoconductor 3Y, which are observed in the image forming area. In the image forming area, as illustrated in FIG. 3, if the charging brush roller 4Y is supplied with the above-described charge bias Vb, i.e., the direct voltage superimposed with the alternating voltage of the relatively high frequency, the surface potential Vd of the photoconductor 3Y becomes uniform.

The photoconductor 3Y carries thereon the post-transfer residual toner. Thus, when the photoconductor 3Y passes through a charging nip portion formed between the photoconductor 3Y and the charging brush roller 4Y, the post-transfer residual toner adheres to the charging brush roller 4Y. The post-transfer residual toner adhering to the charging brush roller 4Y includes positive polar toner and weakly charged toner, which are gradually charged to the negative polarity by the charge bias Vb applied to the charging brush roller 4Y. As indicated by an arrow of FIG. 3, the toner adhering to the charging brush roller 4Y is drawn toward the photoconductor 3Y by an electric field Vt which is formed due to the difference between the surface potential Vd and a minimum alternating voltage $Vb_{min}$ of the charge bias Vb to cause the toner adhering to the charging brush roller 4Y to move to the photoconductor 3Y. The magnitude of the electric field Vt, however, is approximately half the peak-to-peak value $V_{p\text{-}p}$ of the alternating voltage, and thus is insufficient.

In the non-image forming area, therefore, the charging brush roller 4Y is supplied with a charge bias Vb different from the charge bias Vb applied in the image forming area so that a relatively large electric field Vt is formed between the photoconductor 3Y and the charging brush roller 4Y to cause the toner adhering to the charging brush roller 4Y to move to the photoconductor 3Y. Accordingly, the toner adhering to the charging brush roller 4Y is moved to the photoconductor 3Y, and the charging brush roller 4Y is electrostatically cleaned. For example, to uniformly charge the photoconductor 3Y rotating at a linear velocity of approximately 100 mm/sec to a voltage of approximately −500 V, the charging brush roller 4Y is supplied with a charge bias Vb generated by superimposing an alternating voltage having a peak-to-peak value $V_{p\text{-}p}$ of approximately 1.0 kV, a duty ratio of approximately 45%, and a frequency of approximately 8 Hz on a direct voltage of approximately −500 V. The linear velocity of the charging brush roller 4Y is herein assumed to be approximately 250 mm/sec.

Figure 4:
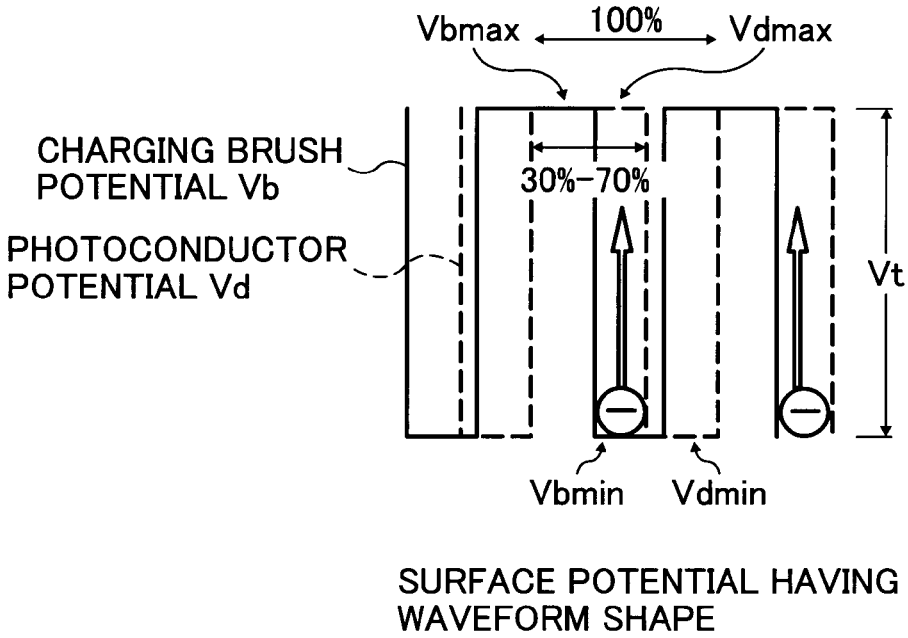
FIG. 4 is an explanatory diagram of a waveform of the charge bias and a waveform of the surface potential of the photoconductor of the printer in a non-image forming area.

FIG. 4 illustrates a waveform of the charge bias Vb applied to the charging brush roller 4Y and a waveform of the surface potential Vd of the photoconductor 3Y, which are observed in the non-image forming area. In the non-image forming area, the charging brush roller 4Y is supplied with a direct voltage superimposed with an alternating voltage having a lower frequency than the frequency of the alternating voltage constituting the charge bias applied in the image forming area. Thereby, as illustrated in FIG. 4, the surface potential Vd of the photoconductor 3Y does not become uniform, and has a waveform shape in accordance with the waveform shape of the alternating voltage. With the thus formed waveform shape of the surface potential Vd of the photoconductor 3Y, an electric field Vt having a magnitude substantially the same as the peak-to-peak value $V_{p\text{-}p}$ of the alternating voltage is formed due to the difference between a maximum surface potential $Vd_{max}$ and a minimum alternating voltage $Vb_{min}$ of the charge bias Vb, as indicated by arrows on the right side of FIG. 4. Due to the relatively large electric field Vt, therefore, the toner adhering to the charging brush roller 4Y is easily moved to the photoconductor 3Y. As a result, cleaning performance is improved.

Figure 5:
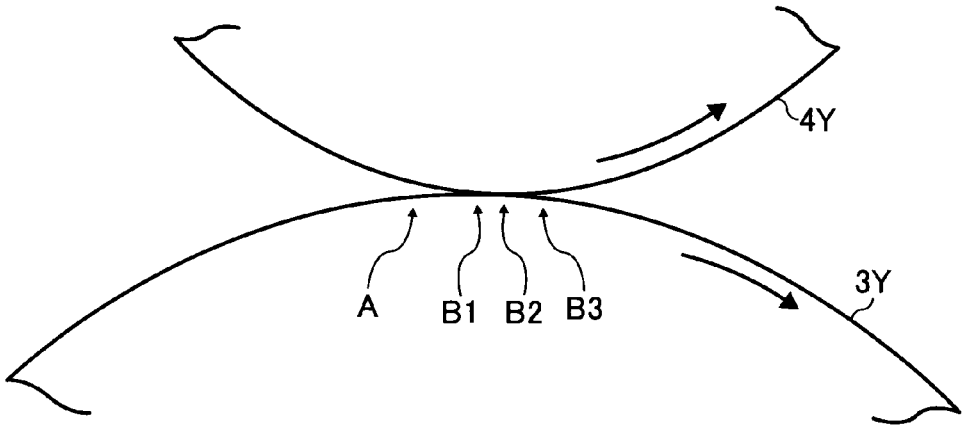
FIG. 5 is an enlarged diagram of a charging nip portion of the printer.
Figure 6A:
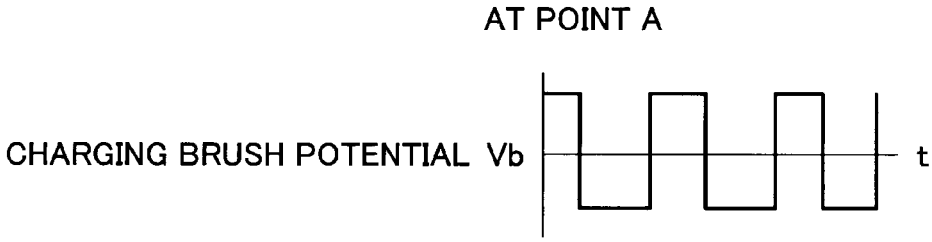
FIGS. 6A and 6B are explanatory diagrams of a charge bias and a surface potential of the photoconductor of the printer at a point A.
Figure 6B:
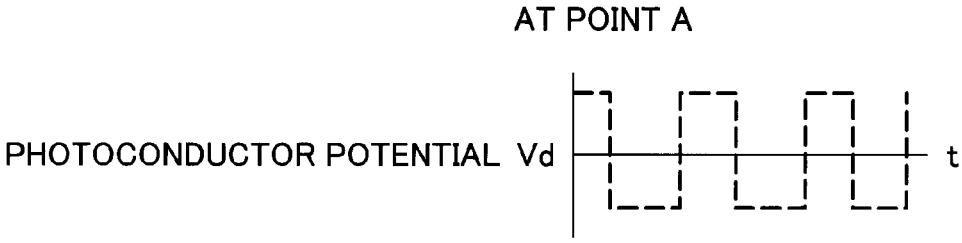

Detailed description will now be made of a mechanism for forming the waveform shape of the surface potential Vd of the photoconductor 3Y as illustrated in FIG. 4 in the non-image forming area. FIG. 5 is an enlarged diagram of the charging nip portion. At a point A on the entrance side of the charging nip portion in FIG. 5, electric discharge occurs in a minute gap formed between the photoconductor 3Y and the charging brush roller 4Y. Thus, the photoconductor 3Y is electrically charged, and the surface potential Vd is obtained. FIGS. 6A and 6B respectively illustrate the charge bias Vb applied to the charging brush roller 4Y and the surface potential Vd of the photoconductor 3Y at the entrance portion of the charging nip portion (i.e., the point A of FIG. 5). FIGS. 6A and 6B illustrate the relationship between the time and the potential at the point A immediately after the electric discharge. At the point A, the surface potential Vd of the photoconductor 3Y has a waveform shape in which the oscillation over time of the surface potential Vd is substantially in accord with the oscillation over time of the charge bias Vb.

Figure 6C:
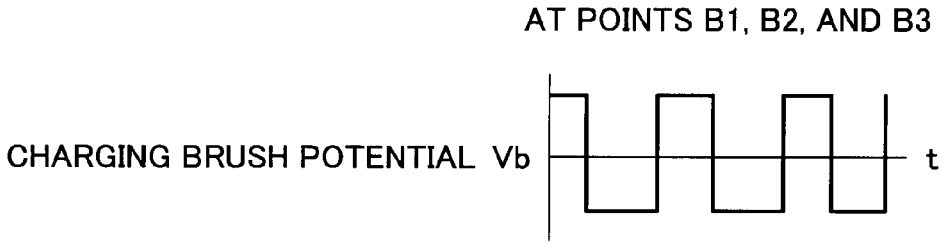
FIGS. 6C to 6F are explanatory diagrams of a charge bias and surface potentials of the photoconductor of the printer at points B1, B2, and B3.
Figure 6D:
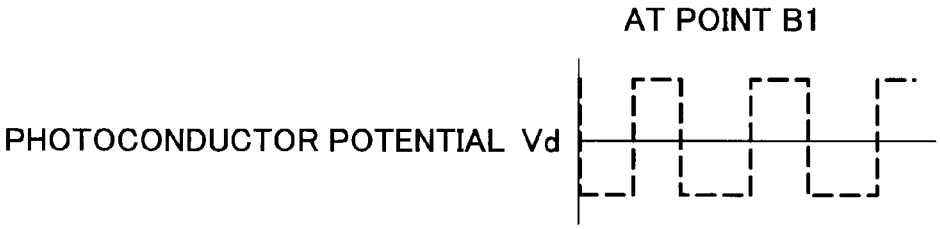
Figure 6E:
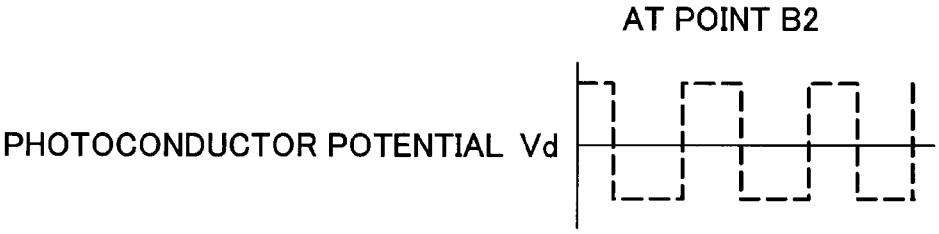
Figure 6F:
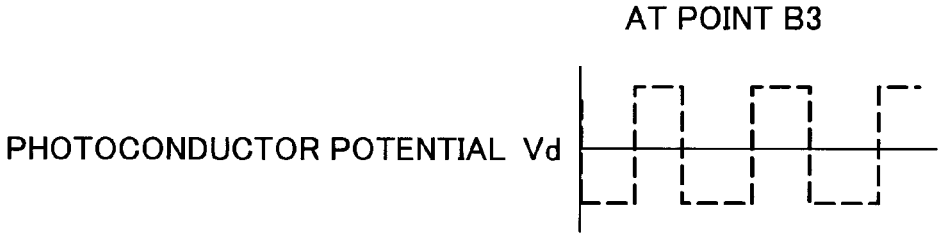

FIG. 6C illustrates the charge bias Vb applied to the charging brush roller 4Y at an upstream portion (i.e., a point B1 of FIG. 5), an intermediate portion (i.e., a point B2 of FIG. 5), and a downstream portion (i.e., a point B3 of FIG. 5) in the charging nip portion. FIGS. 6D to 6F illustrate the surface potentials Vd of the photoconductor 3Y at the point B1, the point B2, and the point B3, respectively. FIGS. 6C to 6F illustrate the relationship between the time and the potential at the points B1, B2, and B3 in the nip portion. The charge bias Vb applied to the charging brush roller 4Y at the points B1, B2, and B3 is the same as the charge bias Vb applied to the charging brush roller 4Y at the point A. Meanwhile, when the photoconductor 3Y, which has been charged at the point A and provided with the surface potential Vd illustrated in FIG. 6B, moves and reaches each of the points B1, B2, and B3, the surface potential Vd of the photoconductor 3Y has a time difference from the charge bias Vb of the charging brush roller 4Y which comes in contact with the photoconductor 3Y. As a result, the surface potential Vd has phase-deviated waveform shapes, as illustrated in FIGS. 6D to 6F. Accordingly, it is possible to obtain the relatively large electric field Vt as illustrated in FIG. 4 described above, which has the magnitude substantially the same as the peak-to-peak value $V_{p\text{-}p}$ of the alternating voltage to cause the toner adhering to the charging brush roller 4Y to move to the photoconductor 3Y. At a position apart from the point A of the charging nip portion by a distance obtained by multiplying the cycle of the waveform by the linear velocity of the photoconductor, the phase deviation does not occur, and thus the waveform shape of the surface potential Vd overlaps with the waveform shape of the charge bias Vb. The above-described distance, however, is a minute distance within the charging nip portion. Therefore, the distance does not affect the transferability of the toner adhering to the charging brush roller 4Y to the photoconductor 3Y.

Description will now be made of an experiment performed to examine the relationship between the waveform shape of the surface potential Vd of the photoconductor 3Y in the non-image forming area and the cleaning performance of the charging brush roller 4Y.

In the experiment, the present inventors prepared a test apparatus similar in configuration to the cleaner-less printer described above. Then, with the use of the test apparatus, the cleaning performance of the charging brush roller 4Y was evaluated, with the waveform shape of the surface potential Vd of the photoconductor 3Y in a non-image forming state changed as needed. Specifically, the following parameters were changed as needed: the magnitude of the electric field Vt (V) illustrated in FIG. 4 for causing the toner adhering to the charging brush roller 4Y to move to the photoconductor 3Y, i.e., the potential difference between the minimum value $Vb_{min}$ (V) of the voltage applied to the charging brush roller 4Y and the maximum value $Vd_{max}$ (V) of the surface potential Vd of the photoconductor 3Y; the time (ms: millisecond) of one cycle of the waveform shape of the surface potential Vd of the photoconductor 3Y (hereinafter referred to as the waveform time); and the ratio (%) in the waveform time of a time required for adjusting the potential to a value causing the toner adhering to the charging brush roller 4Y to move to the photoconductor 3Y (hereinafter referred to as the duty ratio). Under respective conditions, a monochrome half chart (i.e., a halftone or gray-scale image) was printed on a sheet of an A4 size at an image area ratio of 5%. Then, 30,000 sheets were continuously printed, and thereafter the cleaning performance of the charging brush roller 4Y was evaluated. In the evaluation of the cleaning performance, white spot noise in the half chart caused by abnormal electrical discharge due to stains on the charging brush roller 4Y was sensorially evaluated. Specifically, the evaluation was made on a scale of three, i.e., POOR for the presence of white spots, GOOD for the presence of nominal white spots, and EXCELLENT for the absence of white spots. GOOD and EXCELLENT were determined to be an allowable white spot level, while POOR was determined to be a problematic white spot level for practical use.

As a specific condition for the test apparatus, one-component contact-type development was performed in the development device using ground toner having a volume average particle diameter of 8.5 μm (micrometers) and treated with an external additive. Further, the charging brush roller 4Y was formed by a plurality of implanted fiber bristles formed of conductive nylon fiber containing conductive particles and having a volume resistance ratio of approximately $10^8 \Omega \cdot cm$ (ohm centimeters). The plurality of implanted fiber bristles are implanted upright on a rotary shaft member having a diameter of 5 mm to form a roller-like member having a diameter of 11 mm, as the charging brush roller 4Y. The compression amount of the charging brush roller 4Y was set in a range of from 0.1 mm to 1 mm. Then, the minimum value $Vb_{min}$ (V) of the voltage applied to the charging brush roller 4Y was changed within a range of from −250 V to −1700 V, and the maximum value $Vd_{max}$ (V) of the surface potential Vd of the photoconductor 3Y was changed within a range of from −200 V to −500 V. Thus, the magnitude of the electric field Vt (V) was changed within a range of from 50 V to 1200 V. Further, the waveform time (ms) of the surface potential Vd of the photoconductor 3Y was changed within a range of from 50 ms to 120 ms, and the duty ratio was changed within a range of from 20% to 80%. The thus changed conditions and the obtained evaluation results of the cleaning performance are presented in Table 1.

TABLE 1

| | Conditions of Vb and Vd | | | | | |
|---|---|---|---|---|---|---|
| Expt. No. | Vbmin | Vdmax | Electric field Vt (V) | Waveform time (ms) | Duty ratio (of time for moving toner to image carrying member) | Evaluation White spot level after 3000 prints |
| 1 | 250 | 200 | 50 | 50 | 50 | POOR |
| 2 | 350 | 250 | 100 | 1 | 20 | POOR |
| 3 | | | | | 30 | POOR |
| 4 | | | | | 70 | POOR |
| 5 | | | | | 80 | POOR |
| 6 | | | | 3 | 20 | POOR |
| 7 | | | | | 30 | GOOD |
| 8 | | | | | 70 | GOOD |
| 9 | | | | | 80 | POOR |
| 10 | | | | 50 | 20 | POOR |
| 11 | | | | | 30 | EXCELLENT |
| 12 | | | | | 70 | EXCELLENT |
| 13 | | | | | 80 | POOR |
| 14 | | | | 100 | 20 | POOR |
| 15 | | | | | 30 | GOOD |
| 16 | | | | | 70 | GOOD |
| 17 | | | | | 80 | POOR |
| 18 | | | | 120 | 20 | POOR |
| 19 | | | | | 30 | POOR |
| 20 | | | | | 70 | POOR |
| 21 | | | | | 80 | POOR |
| 22 | 800 | 300 | 500 | 50 | 50 | EXCELLENT |
| 23 | 1400 | 400 | 1000 | 1 | 20 | POOR |
| 24 | | | | | 30 | POOR |
| 25 | | | | | 70 | POOR |
| 26 | | | | | 80 | POOR |
| 27 | | | | 3 | 20 | POOR |
| 28 | | | | | 30 | GOOD |
| 29 | | | | | 70 | GOOD |
| 30 | | | | | 80 | POOR |
| 31 | | | | 50 | 20 | POOR |
| 32 | | | | | 30 | EXCELLENT |
| 33 | | | | | 70 | EXCELLENT |
| 34 | | | | | 80 | POOR |
| 35 | | | | 100 | 20 | POOR |
| 36 | | | | | 30 | GOOD |
| 37 | | | | | 70 | GOOD |
| 38 | | | | | 80 | POOR |
| 39 | | | | 120 | 20 | POOR |
| 40 | | | | | 30 | POOR |
| 41 | | | | | 70 | POOR |
| 42 | | | | | 80 | POOR |
| 43 | 1700 | 500 | 1200 | 50 | 50 | POOR |
| 44 | Fixed surface potential of photoconductor | | | | | POOR |

As observed from Table 1, when the magnitude of the electric field Vt for causing the toner adhering to the charging brush roller 4Y to move to the photoconductor 3Y was smaller than 100 V or larger than 1000 V, good cleaning performance was not obtained. Meanwhile, when the magnitude of the electric field Vt, the waveform time of the surface potential Vd of the photoconductor 3Y, and the duty ratio were within a range of from 100 V to 1000 V, a range of from 3 ms to 100 ms, and a range of from 30% to 70%, respectively, good cleaning performance was obtained.

That is, as illustrated in FIG. 4, the toner adhering to the charging brush roller 4Y can be favorably moved to the photoconductor 3Y, if the charging brush roller 4Y is applied, in the non-image forming area, with the charge bias including an alternating voltage having a peak-to-peak value $V_{p\text{-}p}$ and a frequency with which the potential difference between the maximum value $Vd_{max}$ (V) of the surface potential Vd of the photoconductor 3Y and the minimum value $Vb_{min}$ (V) of the voltage applied to the charging brush roller 4Y is within the range of from approximately 100 V to approximately 1000 V, the waveform time of the surface potential Vd of the photoconductor 3Y is within the range of from approximately 3 ms to approximately 100 ms, and the duty ratio is within the range of from approximately 30% to approximately 70%.

To obtain the surface potential Vd of the photoconductor 3Y having the above ranges, the frequency of the alternating voltage of the charge bias Vb applied to the charging brush roller 4Y is set in a range of from approximately 5 Hz to approximately 100 Hz, which is lower than the frequency of the alternating voltage applied in the image forming area. Further, the peak-to-peak value $V_{p\text{-}p}$ is set in a range of from approximately 500 V to approximately 1500 V. With the charging brush roller 4Y applied with the charge bias including the above-described alternating voltage, it is possible to obtain a non-uniform waveform shape of the surface potential Vd of the photoconductor 3Y in accordance with but phase-deviated from the waveform shape of the alternating voltage.

Further, it is possible to secure the magnitude of the electric field for causing the toner adhering to the charging brush roller 4Y to move to the photoconductor 3Y.

The ratio of the circumferential velocity of the charging brush roller 4Y to the circumferential velocity of the photoconductor 3Y is preferably in a range of from approximately 0.1 to approximately 4.0.

The linear velocity of the photoconductor 3Y is preferably in a range of from approximately 50 mm/sec to approximately 300 mm/sec. If the linear velocity of the photoconductor 3Y is higher than approximately 300 mm/sec, the photoconductor 3Y passes through the contact portion of the photoconductor 3Y and the charging brush roller 4Y in a relatively short time. Thus, even if the surface potential of the above-described waveform shape is formed, the transfer of the toner from the charging brush roller 4Y cannot be favorably performed.

The layer thickness of a surface layer of the photoconductor 3Y is preferably in a range of from approximately 15 μm to approximately 30 μm. With the layer thickness of the surface layer of the photoconductor 3Y set in the above-described range, the electric capacity of the photoconductor 3Y can be controlled. Accordingly, the charging brush roller 4Y can be applied with the charge bias including the alternating voltage having the peak-to-peak value $V_{p-p}$ for causing the photoconductor 3Y to have the surface potential Vd of the above-described waveform shape. If the layer thickness of the surface layer of the photoconductor 3Y is too small, the surface of the photoconductor 3Y becomes less likely to be charged, and thus a sufficient surface potential cannot be obtained. Meanwhile, if the layer thickness of the surface layer of the photoconductor 3Y is too large, the sensitivity of the photoconductor 3Y is deteriorated, and thus a good electrostatic latent image cannot be formed.

The sensitivity of the photoconductor 3Y is preferably in a range of from approximately 0.08 $\mu J/cm^2$ (microjoules per square centimeter) to approximately 0.20 $\mu J/cm^2$. If the sensitivity is too low, a good electrostatic latent image cannot be formed in a relatively short time. Meanwhile, if the sensitivity is too high, the attenuation of the electric potential is facilitated, and thus the development process is adversely affected.

Figure 7:
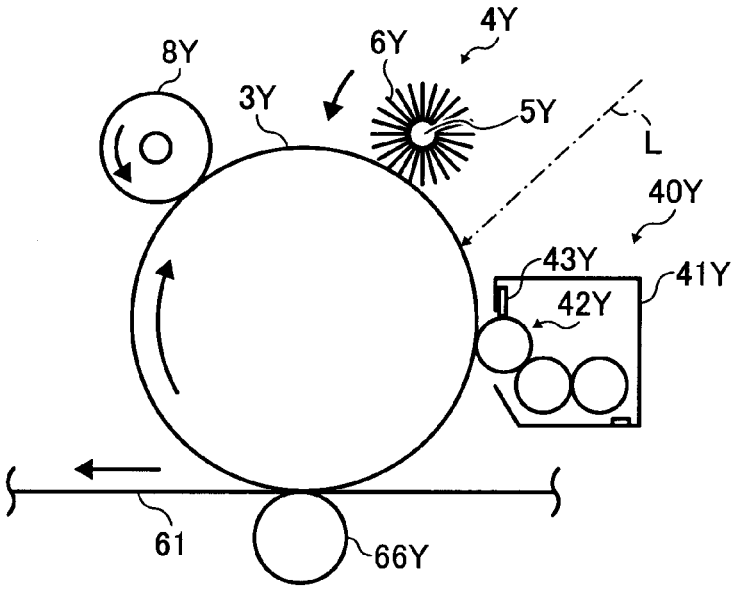
FIG. 7 is an enlarged configuration diagram illustrating a processing unit according to a modified example.

FIG. 7 is a schematic configuration diagram of a modified example of the processing unit according to the present embodiment. In the modified example, a subsidiary charging roller 8Y is provided upstream of the charging brush roller 4Y. The subsidiary charging roller 8Y is supplied with a voltage to charge the toner on the photoconductor 3Y to the negative polarity. The toner charged to the negative polarity by the subsidiary charging roller 8Y is easily moved to the photoconductor 3Y by the electric field Vt formed between the charging brush roller 4Y and the photoconductor 3Y in the non-image forming area, even if the toner adheres to the charging brush roller 4 in the contact portion of the photoconductor 3Y and the charging brush roller 4Y located downstream of the subsidiary charging roller 8Y. Accordingly, further better cleaning performance can be obtained.

Figure 8:
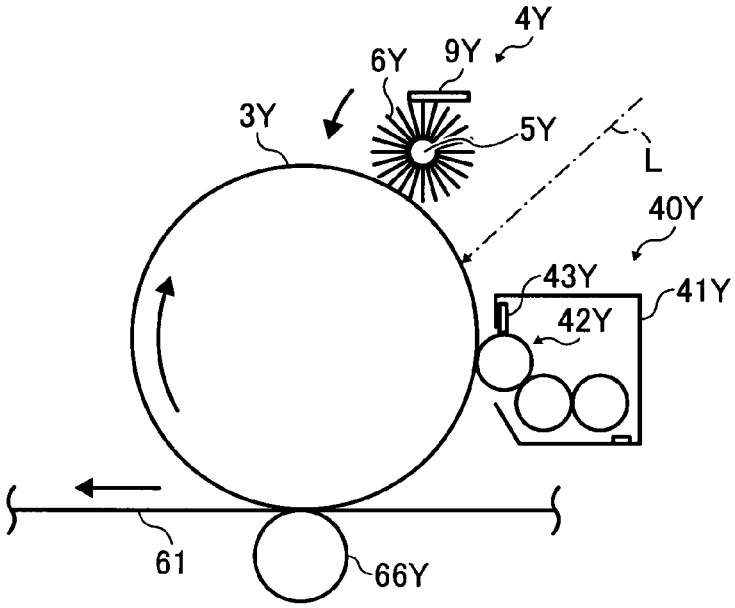
FIG. 8 is an enlarged configuration diagram of a processing unit according to still another modified example.

FIG. 8 is a schematic configuration diagram of another modified example of the processing unit according to the present embodiment. In the modified example, a conductive sheet 9Y is provided to come in contact with the charging brush roller 4Y. The conductive sheet 9Y is supplied with a voltage to charge the toner on the charging brush roller 4Y to the negative polarity. The toner charged to the negative polarity by the conductive sheet 9Y is easily moved to the photoconductor 3Y by the electric field Vt formed between the charging brush roller 4Y and the photoconductor 3Y in the non-image forming area. Accordingly, further better cleaning performance can be obtained.

In the embodiment described above, the alternating voltage has a rectangular waveform. The present invention, however, can be similarly applied to an alternating voltage having another waveform, such as a sinusoidal waveform and a triangular waveform.

Further, the embodiment described above uses the tandem-type full-color printer including the intermediate transfer member. The present invention, however, is not limited thereto, and thus can also be applied to a single-drum full-color printer which supplies toner of a plurality of colors to a single photoconductor and a printer which forms a single-color image. Similar effects as the effects of the above-described embodiment can also be obtained in such printers.

According to the embodiment described above, in the non-image forming area, the charging brush roller 4Y is supplied with the charge bias Vb including the alternating voltage of a lower frequency than the frequency of the alternating voltage of the charge bias Vb applied in the image forming area. Accordingly, unlike in the image-forming area, the surface potential Vd of the photoconductor 3Y is not set to a constant value, and has the waveform shape in accordance with the alternating voltage applied to the charging brush roller 4Y. Then, due to the potential difference between the surface potential Vd of the above-described waveform shape and the charge bias Vb, the electric field Vt is formed which causes the toner adhering to the charging brush roller 4Y to move to the photoconductor 3Y. Accordingly, the toner is moved from the charging brush roller 4Y to the photoconductor 3Y, and the charging brush roller 4Y is cleaned. Specifically, as illustrated in FIG. 4, due to the potential difference between the maximum value $Vd_{max}$ of the surface potential Vd of the photoconductor 3Y and the minimum value $Vb_{min}$ of the charge bias Vb applied to the charging brush roller 4Y, the electric field Vt (indicated by the arrows on the right side of FIG. 4) having a substantially similar magnitude to the peak-to-peak value $V_{p-p}$ of the alternating voltage is formed. According to the above method, a relatively large electric field can be easily obtained without disadvantages, as compared with the previously described background art which changes the value of the direct voltage to obtain the electric field Vt. Accordingly, the toner adhering to the charging brush roller 4Y is easily moved to the photoconductor 3Y by the relatively large electric field Vt. As a result, the cleaning performance can be improved.

Further, the foregoing experiment has revealed the condition under which the toner adhering to the charging brush roller 4Y is effectively moved to the photoconductor 3Y in the above-described method. That is, the magnitude of the electric field Vt, the cycle of the waveform shape of the surface potential Vd of the photoconductor 3Y, and the ratio of the potential in the cycle for causing the toner to move to the photoconductor 3Y are set in the range of from approximately 100 V to approximately 1000 V, the range of from approximately 3 ms to 100 ms, and the range of from approximately 30% to approximately 70%, respectively. If the magnitude of the electric field Vt is smaller than approximately 100 V, the toner is not favorably moved. Meanwhile, if the magnitude of the electric field Vt is larger than approximately 1000 V, an electric leakage tends to occur, and thus the movement of the toner is prevented in some cases. Further, if the cycle of the waveform shape of the surface potential Vd of the photoconductor 3Y is shorter than approximately 3 ms, the toner becomes less likely to follow the electric field Vt. Meanwhile, if the cycle is longer than approximately 100 ms, a sufficient time required for the toner movement in the charging nip portion cannot be obtained. It was thus revealed that the toner cannot be favorably moved in either case. Furthermore, if the ratio of the surface potential Vd for causing the toner to move to the photoconductor 3Y is lower than approximately 30%, the toner becomes less likely to follow the electric field Vt. Meanwhile, if the ratio is higher than approximately 70%, a sufficient time required for the toner movement in the charging nip portion cannot be obtained. It was thus revealed that the toner cannot be favorably moved in either case.

Further, if the frequency of the alternating voltage included in the voltage applied to the charging brush roller 4Y in the non-image forming area is set in the range of from approximately 5 Hz to approximately 100 Hz, the photoconductor 3Y can be charged to the surface potential having the above-described waveform shape.

Further, if the peak-to-peak value $V_{p\text{-}p}$ of the alternating voltage included in the voltage applied to the charging brush roller 4Y in the non-image forming area is set in the range of from approximately 500 V to approximately 1500 V, the photoconductor 3Y can be charged to the surface potential having the above-described waveform shape.

Further, a particularly effective advantage can be obtained by applying the present invention to a cleaner-less printer.

Further, a particularly effective advantage can be obtained by employing the charging brush roller 4Y in the present invention. The charging brush roller 4Y is desirably formed by fiber made of a material selected from nylon, acrylic, and Teflon (a registered trademark).

Further, the ratio of the circumferential velocity of the charging brush roller 4Y to the circumferential velocity of the photoconductor 3Y is preferably in the range of from approximately 0.1 to approximately 4.0.

Further, the linear velocity of the photoconductor 3Y is preferably in the range of from approximately 50 mm/sec to approximately 300 mm/sec. If the linear velocity of the photoconductor 3Y is higher than approximately 300 mm/sec, the photoconductor 3Y passes through the contact portion of the photoconductor 3Y and the charging brush roller 4Y in a relatively short time. Thus, even if the surface potential of the above-described waveform shape is formed, the toner is not favorably moved from the charging brush roller 4Y.

Further, the layer thickness of the surface layer of the photoconductor 3Y is preferably in the range of from approximately 15 μm to approximately 30 μm. With the layer thickness of the surface layer of the photoconductor 3Y set in the above range, the electric capacity of the photoconductor 3Y can be controlled. Accordingly, the charging brush roller 4Y can be applied with the voltage including the alternating voltage having the peak-to-peak value $V_{p\text{-}p}$ for causing the photoconductor 3Y to have the surface potential of the above-described waveform shape. If the layer thickness of the surface layer of the photoconductor 3Y is too small, the surface of the photoconductor 3Y becomes less likely to be charged, and thus a sufficient surface potential cannot be obtained. Meanwhile, if the layer thickness of the surface layer of the photoconductor 3Y is too large, the sensitivity of the photoconductor 3Y is deteriorated, and thus a good electrostatic latent image cannot be formed.

Further, the sensitivity of the photoconductor 3Y is preferably in the range of from approximately 0.08 $\mu J/cm^2$ to approximately 0.20 $\mu J/cm^2$. If the sensitivity is too low, a good electrostatic latent image cannot be formed in a relatively short time. Meanwhile, if the sensitivity is too high, the attenuation of the electric potential is facilitated, and thus the development process is adversely affected.

The above-described embodiments are illustrative and do not limit the present invention. Thus, numerous additional modifications and variations are possible in light of the above teachings. For example, elements and/or features of different illustrative and exemplary embodiments herein may be combined with each other and/or substituted for each other within the scope of this disclosure and appended claims. Further, features of components of the embodiments, such as the number, the position, and the shape, are not limited the embodiments and thus may be preferably set. It is therefore to be understood that within the scope of the appended claims, the disclosure of this patent specification may be practiced otherwise than as specifically described herein.

The invention claimed is:

1. An image forming apparatus comprising:

an image carrying member having a movable surface;

a charging means including a rotatable charging member, the charging member supplied with a voltage including a direct voltage superimposed with an alternating voltage, and brought into contact with the image carrying member to charge the surface of the image carrying member;

an electrostatic latent image forming device for forming an electrostatic latent image on the surface of the image carrying member; and a development device for developing the electrostatic latent image formed on the surface of the image carrying member, wherein a frequency of the alternating voltage included in the voltage applied to the charging member is lower in a non-image forming area than in an image forming area, and wherein, in the non-image forming area, the image carrying member is charged to a surface potential having a waveform shape that reflects the alternating voltage to form an electrical field for moving toner adhering to a surface of the charging member to the image carrying member from a potential difference between the surface potential and the voltage applied to the charging member to move the toner from the charging member to the image carrying member, wherein a magnitude of the electrical field ranges from approximately 100 volts to approximately 1000 volts, wherein a cycle of the waveform shape of the surface potential of the image carrying member ranges from approximately 3 milliseconds to approximately 100 milliseconds, and wherein a ratio, in the cycle of the waveform shape, of the electric potential for moving the toner to the image carrying member ranges from approximately 30 percent to approximately 70 percent.

2. The image forming apparatus as described in claim 1, wherein the frequency of the alternating voltage included in the voltage applied to the charging member in the non-image forming area ranges from approximately 5 hertz to approximately 100 hertz.

3. The image forming apparatus as described in claim 1, wherein a peak-to-peak value of the alternating voltage included in the voltage applied to the charging member in the non-image forming area ranges from approximately 500 volts to approximately 1500 volts.

4. The image forming apparatus as described in claim 1, wherein the development device includes a developer carrying member, the development device developing the electrostatic latent image formed on the surface of the image carrying member into a toner image with toner carried on a surface of the developer carrying member, wherein the image forming apparatus includes a transfer device for transferring the toner image formed on the surface of the image carrying member onto a recording medium, and wherein post-transfer residual toner left on the surface of the image carrying member by the transfer device is collected from the surface of the image carrying member onto the surface of the developer carrying member.

5. The image forming apparatus as described in claim 1, wherein the charging member includes a charging brush roller.

6. The image forming apparatus as described in claim 5, wherein the charging brush roller includes fiber selected from a group consisting of nylon, acrylic, and polytetrafluoroethylene.

7. The image forming apparatus as described in claim 1, wherein a ratio of a linear velocity of the charging member to a linear velocity of the image carrying member ranges from approximately 0.1 to approximately 4.0.

8. The image forming apparatus as described in claim 1, wherein the linear velocity of the image carrying member ranges from approximately 50 millimeters per second to approximately 300 millimeters per second.

9. The image forming apparatus as described in claim 1, wherein a thickness of a surface layer of the image carrying member ranges from approximately 15 micrometers to approximately 30 micrometers.

10. The image forming apparatus as described in claim 1, wherein a sensitivity of the image carrying member ranges from approximately 0.08 microjoules per square centimeter to approximately 0.20 microjoules per square centimeter.

11. An image forming apparatus comprising:

image carrying means for carrying an image on a movable surface thereof;

charging means including rotatable charging means, and causing the rotatable charging means to be supplied with a voltage including a direct voltage superimposed with an alternating voltage and to come in contact with the image carrying means to charge the surface of the image carrying means;

electrostatic latent image forming means for forming an electrostatic latent image on the surface of the image carrying means; and development means for developing the electrostatic latent image formed on the surface of the image carrying means, wherein a frequency of the alternating voltage included in the voltage applied to the rotatable charging means is set to be lower in a non-image forming area than in an image forming area, and wherein, in the non-image forming area, the image carrying means is charged to a surface potential having a waveform shape that reflects the alternating voltage to form an electrical field for moving toner adhering to a surface of the rotatable charging means to the image carrying means from a potential difference between the surface potential and the voltage applied to the rotatable charging means to move the toner from the rotatable charging means to the image carrying means, wherein a magnitude of the electrical field ranges from approximately 100 volts to approximately 1000 volts, wherein a cycle of the waveform shape of the surface potential of the image carrying member ranges from approximately 3 milliseconds to approximately 100 milliseconds, and wherein a ratio, in the cycle of the waveform shape, of the electric potential for moving the toner to the image carrying member ranges from approximately 30 percent to approximately 70 percent.

12. The image forming apparatus as described in claim 11, wherein the frequency of the alternating voltage included in the voltage applied to the charging means in the non-image forming area ranges from approximately 5 hertz to approximately 100 hertz.

13. The image forming apparatus as described in claim 11, wherein a peak-to-peak value of the alternating voltage included in the voltage applied to the charging means in the non-image forming area ranges from approximately 500 volts to approximately 1500 volts.

14. The image forming apparatus as described in claim 11, wherein the development means includes a developer carrying means, the development means developing the electrostatic latent image formed on the surface of the image carrying means into a toner image with toner carried on a surface of the developer carrying means, wherein the image forming apparatus includes a transfer means for transferring the toner image formed on the surface of the image carrying means onto a recording medium, and wherein post-transfer residual toner left on the surface of the image carrying means by the transfer means is collected from the surface of the image carrying means onto the surface of the developer carrying means.

15. The image forming apparatus as described in claim 11, wherein the charging means includes a charging brush roller.

16. The image forming apparatus as described in claim 15, wherein the charging brush roller includes fiber selected from a group consisting of nylon, acrylic, and polytetrafluoroethylene.

17. The image forming apparatus as described in claim 11, wherein a ratio of a linear velocity of the charging means to a linear velocity of the image carrying means ranges from approximately 0.1 to approximately 4.0.

18. The image forming apparatus as described in claim 11, wherein the linear velocity of the image carrying means ranges from approximately 50 millimeters per second to approximately 300 millimeters per second.

19. The image forming apparatus as described in claim 11, wherein a thickness of a surface layer of the image carrying means ranges from approximately 15 micrometers to approximately 30 micrometers.

20. An image forming method comprising the steps of:

rotating a movable surface of an image carrying member;

supplying a rotatable charging member of a charging device with a voltage including a direct voltage superimposed with an alternating voltage;

charging the surface of the image carrying member by bringing the charging member into contact with the surface of the image carrying member;

forming an electrostatic latent image on the surface of the image carrying member; and developing the electrostatic latent image formed on the surface of the image carrying member, wherein the supplying step sets a frequency of the alternating voltage included in the voltage applied to the rotatable charging member to be lower in a non-image forming area than in an image forming area, and wherein, in the non-image forming area, the charging step charges the surface of the image carrying member to a surface potential having a waveform shape that reflects the alternating voltage to form an electrical field for moving toner adhering to a surface of the charging member to the image carrying member from a potential difference between the surface potential and the voltage applied to the charging member to move the toner from the charging member to the image carrying member, wherein a magnitude of the electrical field ranges from approximately 100 volts to approximately 1000 volts, wherein a cycle of the waveform shape of the surface potential of the image carrying member ranges from approximately 3 milliseconds to approximately 100 milliseconds, and wherein a ratio, in the cycle of the waveform shape, of the electric potential for moving the toner to the image carrying member ranges from approximately 30 percent to approximately 70 percent.

* * * * *